US007823884B2

(12) United States Patent
Cantner

(10) Patent No.: US 7,823,884 B2
(45) Date of Patent: Nov. 2, 2010

(54) SPHERICAL PUZZLE

(75) Inventor: Christopher Paul Cantner, 1359 Pierce Place, Coquitlam, BC (CA) V5R 4G7

(73) Assignee: Christopher Paul Cantner, Coquitlam BC (CA)

( * ) Notice: Subject to any disclaimer, the term of this patent is extended or adjusted under 35 U.S.C. 154(b) by 219 days.

(21) Appl. No.: 12/112,381

(22) Filed: Apr. 30, 2008

(65) Prior Publication Data

US 2009/0058001 A1 Mar. 5, 2009

Related U.S. Application Data

(60) Provisional application No. 60/915,428, filed on May 1, 2007.

(51) Int. Cl.
*A63F 9/08* (2006.01)

(52) U.S. Cl. ..... 273/153 S

(58) Field of Classification Search ..... 273/153 S, 273/157 R

See application file for complete search history.

(56) References Cited

U.S. PATENT DOCUMENTS 4,378,116 A 3/1983 Rubik
4,378,117 A 3/1983 Rubik
4,441,715 A 4/1984 Titus
D274,280 S * 6/1984 Kremer ..... 273/153 S
4,522,401 A * 6/1985 Gustafson ..... 273/153 S
4,557,484 A * 12/1985 Sherman et al. ..... 273/153 S
4,856,786 A * 8/1989 Gyovai ..... 273/153 S
4,865,323 A * 9/1989 Heusinkveld ..... 273/153 S
5,338,033 A * 8/1994 Nunez Serrano ..... 273/153 S
5,358,247 A 10/1994 Meffert
5,452,895 A 9/1995 Ray
6,422,559 B1 * 7/2002 Utkin ..... 273/153 S
6,644,665 B1 11/2003 Brooks
6,857,632 B2 * 2/2005 Tanner ..... 273/153 S
6,974,130 B2 12/2005 Sugden
7,108,263 B2 * 9/2006 Cabeza et al. ..... 273/153 S

* cited by examiner

*Primary Examiner*—Steven Wong

(57) ABSTRACT

A spherical logical puzzle is disclosed comprising of a plurality of elements symmetrical about three axes and planes. The puzzle is solved by rotating the elements on the surface of the sphere to align a surface pattern or numerical set. The surface of sphere is divided into octants of 4 elements; 3 quarter polar sections and one shell section. These surface elements are rearranged by rotating hemispherical sets of four octants at a time. When rotating a hemisphere of elements, the polar segments of that hemisphere do not rotate, thus creating a unique and novel puzzle.

5 Claims, 16 Drawing Sheets

SPHERICAL PUZZLE

CROSS-REFERENCE TO RELATED APPLICATIONS

Related U.S. Application Data

This application claims the benefit of provisional patent application No. 60/915,428, filed on May 1, 2007.

FIELD OF THE INVENTION

This present invention relates generally to three-dimensional puzzles, more specifically, manipulable spatial logical puzzles of spherical shape with rotating or moving elements.

BACKGROUND OF THE INVENTION

The Rubik's Cube (trademark) is a three-dimensional manipulable puzzle of an assortment of configurations of elements and/or exterior designs (2×2×2, 3×3×3, 4×4×4, etc). Since the original set of patents of designs and mechanism of the Rubik's cube [U.S. Pat. Nos. 4,378,116 and 4,378,117] there have been many new designs and mechanisms improving and expanding the three-dimensional puzzles for game play, exterior design and internal mechanism, [U.S. Pat. Nos. 4,513,970, 4,540,177, 5,338,033, 4,593,907, 6,422,559, 6,644,665, and 6,974,130] including making the exterior surface spherical rather than cubic. Unfortunately, the results of a lot of these improvements have not actually changed the way the puzzle is solved, nor have they changed the difficulty of solving the puzzle except to add more elements.

Spherical three-dimensional manipulable puzzles have been created that do not follow the basic element patterns of the Rubik's cube and its spherical variants. Examples include U.S. Pat. Nos. 4,441,715 4,865,323, 5,358,247, 5,452,895, 6,857,632, and possibly 4,513,970. These puzzles all have spherical shapes with elements of varying shapes that can be rotated around the surface to assemble a puzzle with a image or set of identifiers on the surface that can be aligned together when solved. The draw back of all these spherical puzzles is that because these element shapes are not symmetrical on all three axes, pieces' shapes aid in the game play, making the puzzle easier to solve.

Other three-dimensional manipulable puzzles that are not necessarily spherical in shape, but have game play puzzle solving in a manor like the Rubik's cube include U.S. Pat. Nos. 4,836,549 and 4,593,908. These puzzles are of odd geometrical shapes, but include unique mechanisms that allow rotations of sections and elements for innovative game play. Similar to the spherical puzzles above however, they have unique shapes and locations of elements that provide easier references for players to solve the puzzle.

SUMMARY OF THE INVENTION

The present invention is a spherical puzzle that has a set of elements unique to a sphere, which provides a more challenging new game playing experience.

Movement of the elements of the sphere comprises of rotating two hemispheres, where elements forming the pole of one of the rotating hemispheres do not rotate with the rest of their respective hemispheres. This behaviour is replicated on all axes of the puzzle. The movement of only part of a hemisphere is a key feature in the uniqueness and challenge of this invention in comparison to prior art described above.

One rotational movement is complete when poles of the other axes align allowing for movement of other hemispheres along other planes. The solution of the puzzle is identified by configuring the elements to align designs or patterns on the surface of the sphere. Elements of the puzzle are symmetrical along all the axes not allowing easily identifiable reference elements to aid in the solution of the puzzle as in prior art puzzles noted above.

DETAILED DESCRIPTION OF THE INVENTION AND PREFERRED EMBODIMENT

Figure 1:
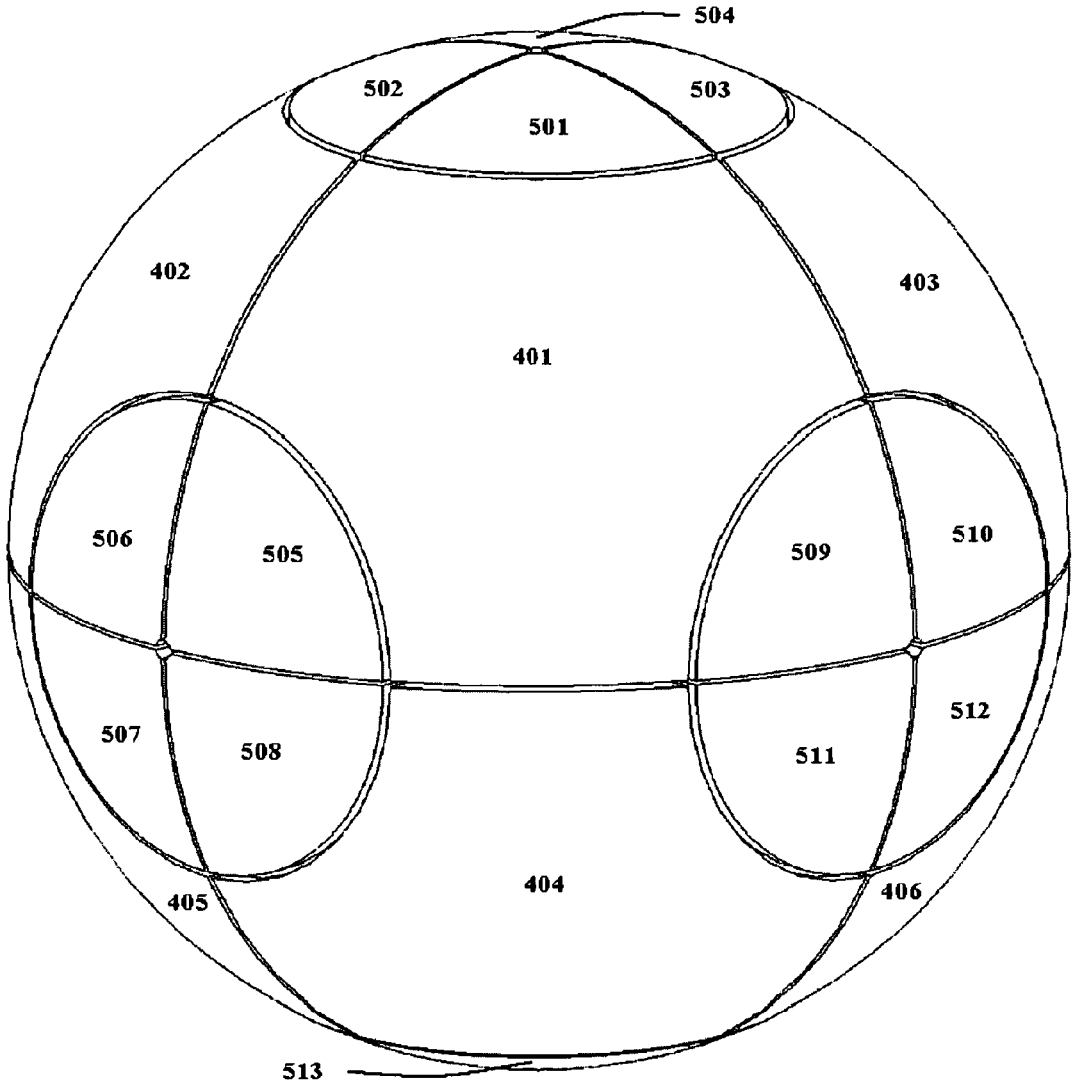
FIG. 1 is a perspective view of an embodiment of the invention.
Figure 2:
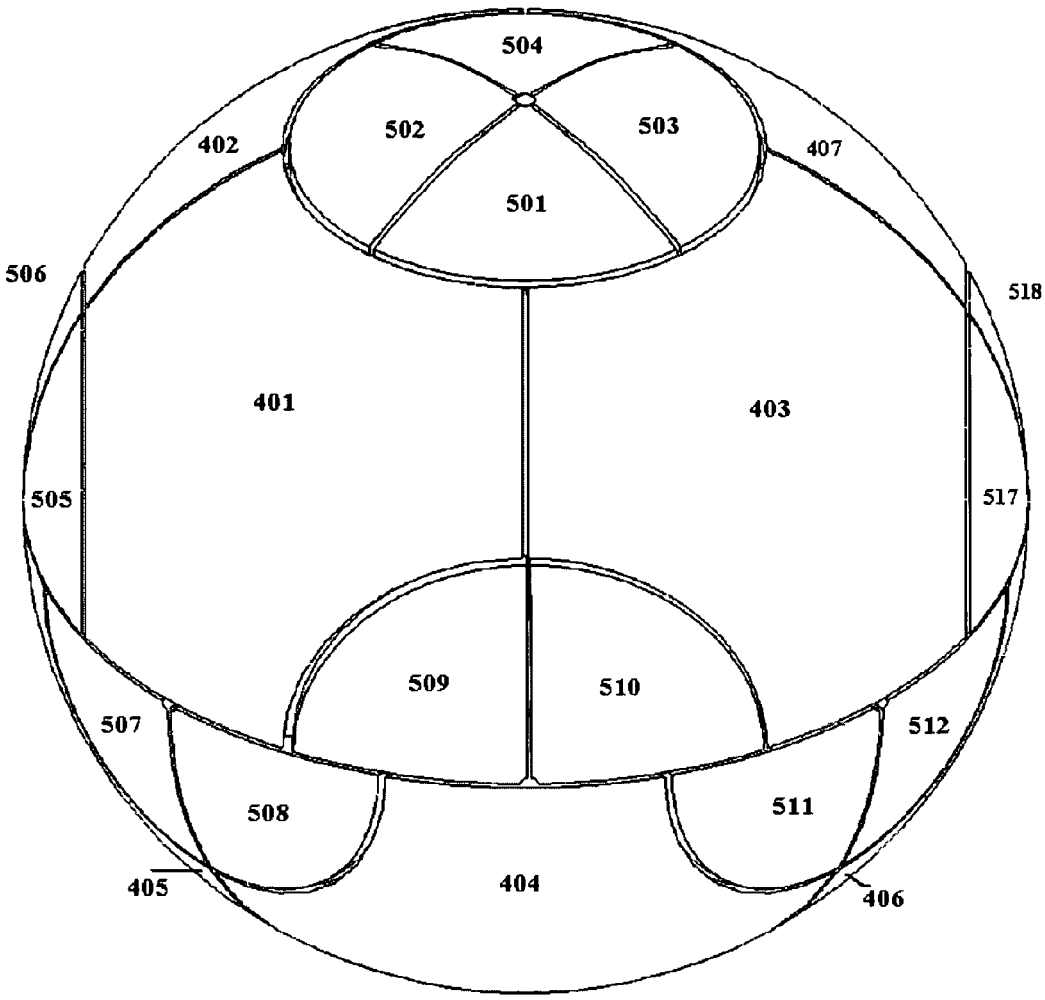
FIG. 2 is a view of FIG. 1 illustrating the movement of one hemisphere relative to another hemisphere with one pole not rotating with its hemisphere. The top hemisphere is rotated halfway to a quarter turn relative to the bottom hemisphere.

FIG. 1 shows an embodiment of the invention in the form of a spherical logical puzzle. The surface of the sphere when divided into 8 octants, along the edges of the octant elements 401, 402, 403, 404, 405, 406, 407 and 408 comprises of one octant shell segment (for example element 401), and three pieces each a quarter of a pole of the sphere (for example elements 501, 505 and 509).

Figure 3:
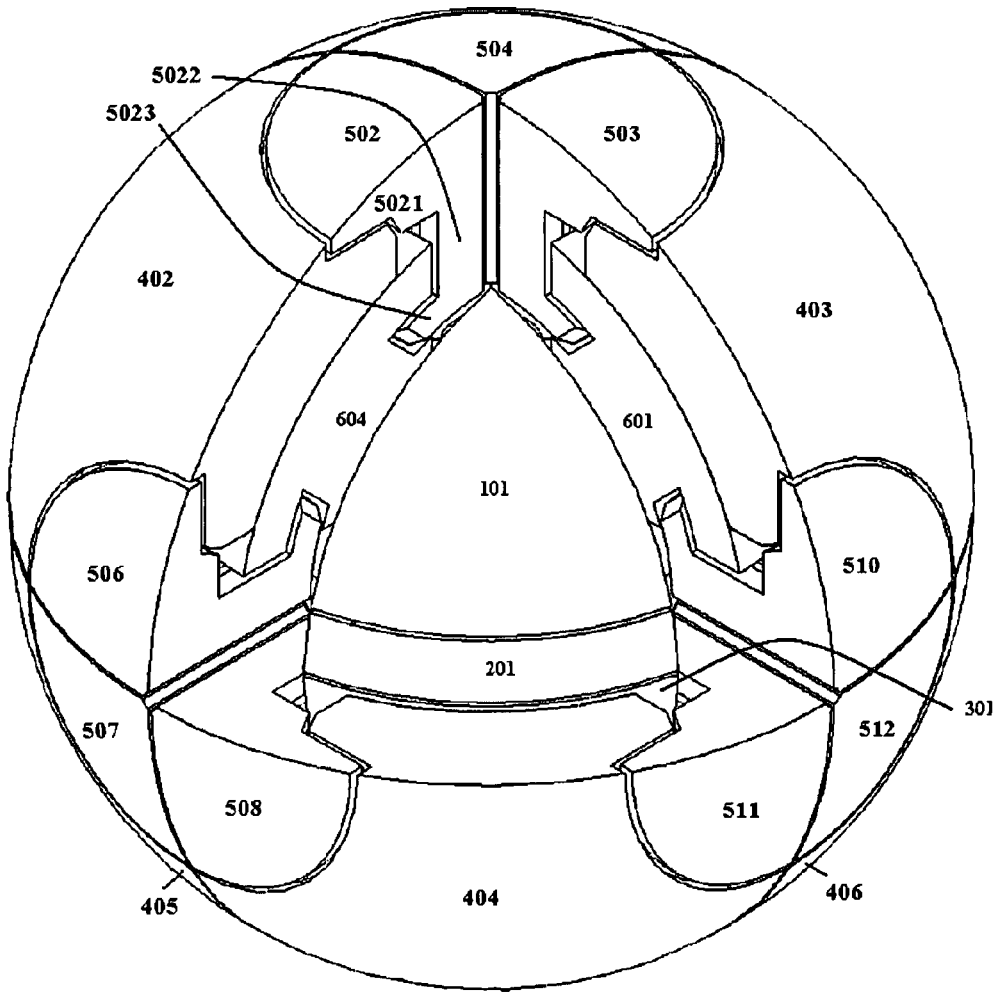
FIG. 3 is a similar view of FIG. 1 with an octant of surface elements omitted (elements 401, 501, 505, and 509) to illustrate how quarter polar sections (Ex: 510) hold shell octant sections (Ex: 403) to the core and how polar quarter elements fit into grooves of core (elements 101, 201, and 301) and core spacer elements (elements 601 and 604).

With reference to FIG. 3, the octant pieces (for example element 402) are held in place by the shell headers (5021) of the polar quarter segments (502, 506 and 521 not seen) which are secured by the shafts (5022) to footer tongues (5023) of the polar quarter segments that fit and slide in the grooves and sliders in the core. When four octants rotate about an axis, the polar segments that lie along such axis do not rotate. The polar segments not lying in the rotational axis, are guided along through the core channels and grooves via sliding elements 201 or 601, 602, 603.

Figure 4:
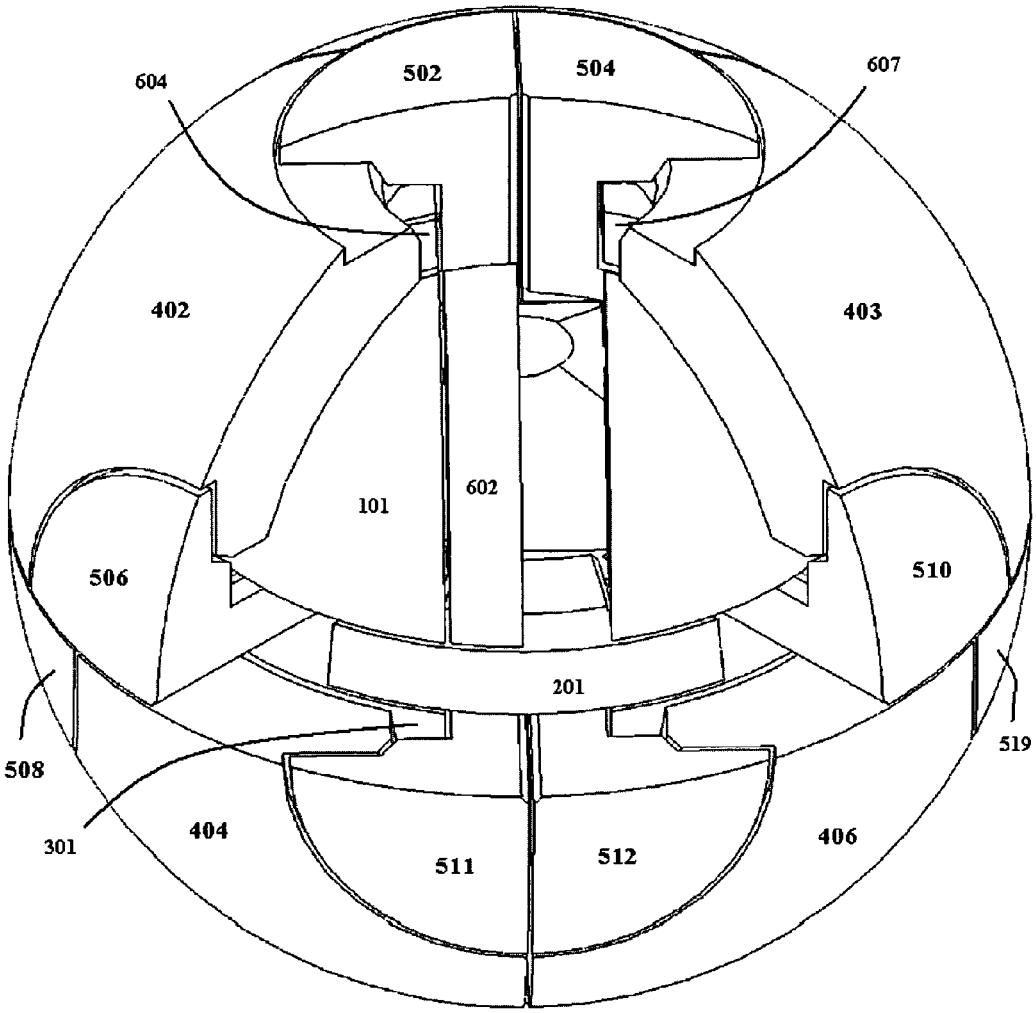
FIG. 4 is a similar view to FIG. 2 with elements omitted similar to FIG. 3 to show sliding polar and internal spacing elements in the core grooves halfway through a rotation. The rotation is about the extraordinary axis defined by the unique spacer element part of the core (element 201) assisting the polar sections rotate (Ex: 506 and 510) around and through the grooves of the core (element 101) and slider sections (elements 602, 604 and 607).
Figure 5:
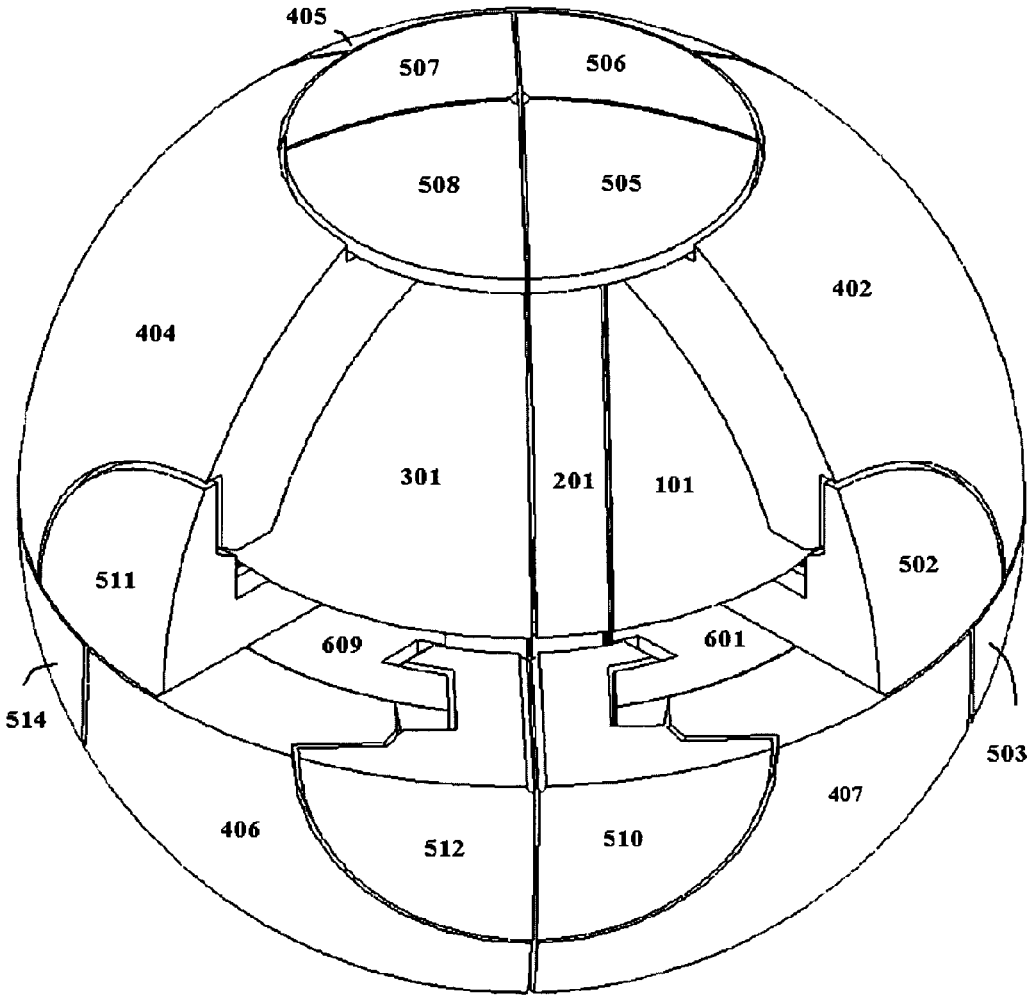
FIG. 5 is a similar view to FIG. 4 to show sliding polar and internal spacing elements in the core grooves halfway through a rotation. The rotation is about an ordinary axis defined spacer elements in the core (elements 601 and 609) assisting the polar sections rotate (Ex: 502 and 511) around and through the grooves of the core (elements 101 and 301) and the extraordinary slider section (element 201).
Figure 6:
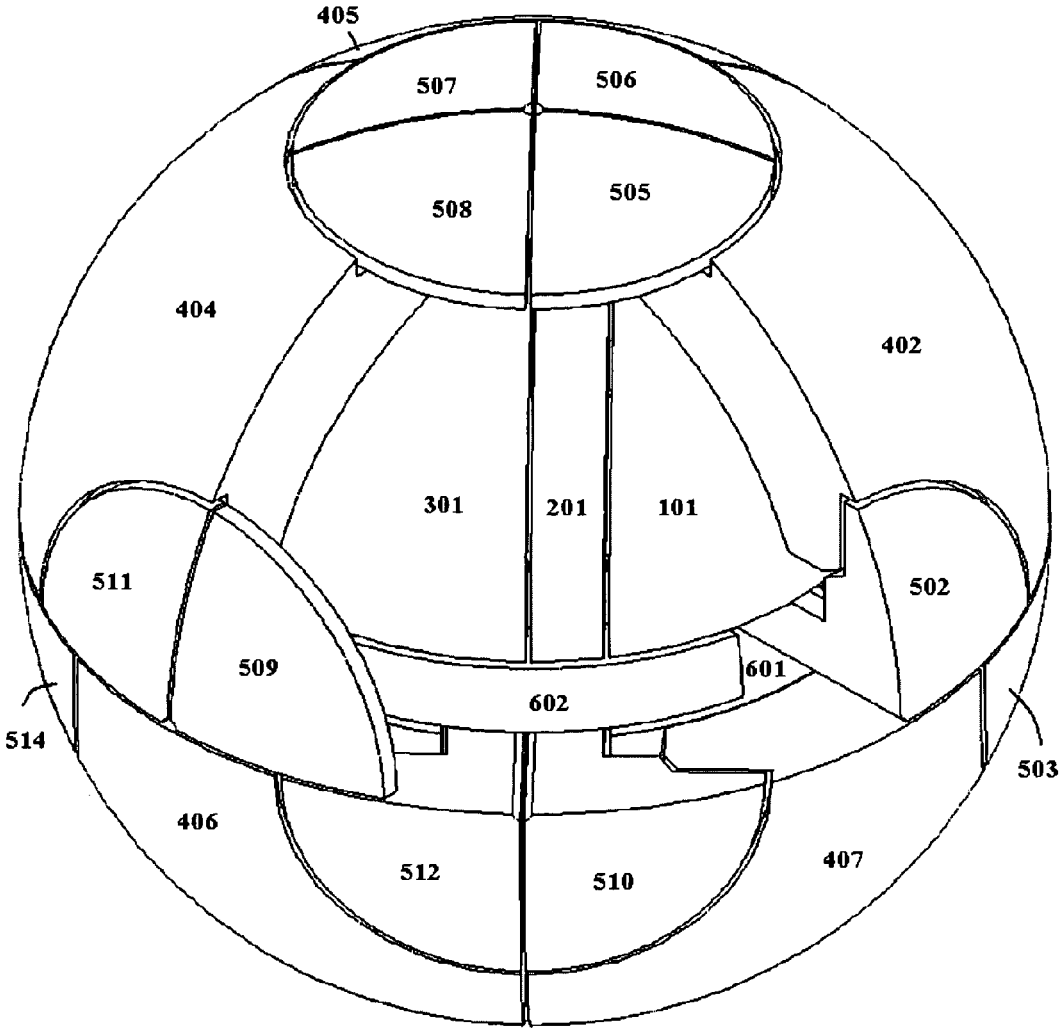
FIG. 6 is a view similar to FIG. 5 with spacer a section (element 602) and a quarter polar section (element 509) revealed.

As illustrated in FIGS. 4, 5, and 6, polar segments are aided as they travel through the channel 150 (of FIG. 7), and channel grooves 151 (of FIG. 7) of the core by sliding elements 201 or 601, 602, 603. These sliding or spacer elements provide proper spacing for the polar segments, and ensure the polar elements do not get stuck in the channels they may be passing through. Spacer elements are in the shape of a quarter cylinder with a protruding tongue (6011) on one side and grooves (6022) on each end. The grooves act similar to the grooves of the core elements, and the tongues fit into and slide through grooves of the core and other spacer elements.

Figure 7:
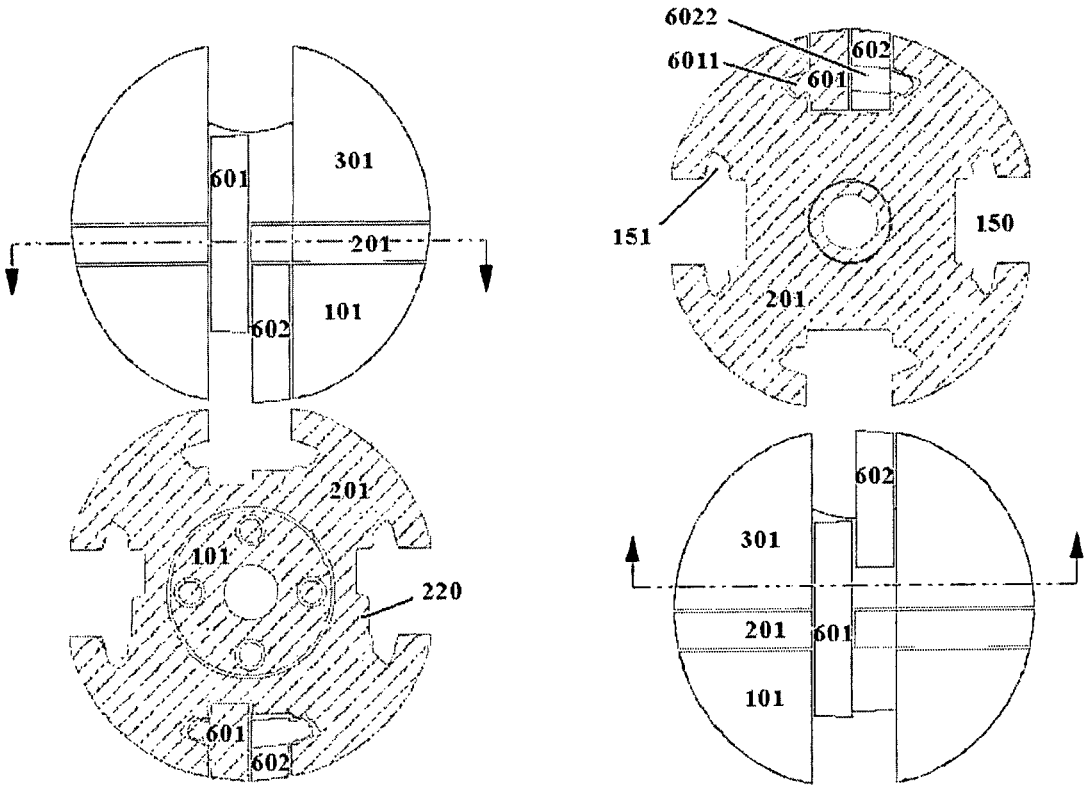
FIG. 7 is two cross sectional views of one the core elements (301) and the unique slider section (201) to illustrate how one hemisphere rotates about an ordinary axis. Slider section on one side (601) slides freely and the other slider section (602) is blocked by a lip (220) in the channel of the core's unique slider section (201).
Figure 8:
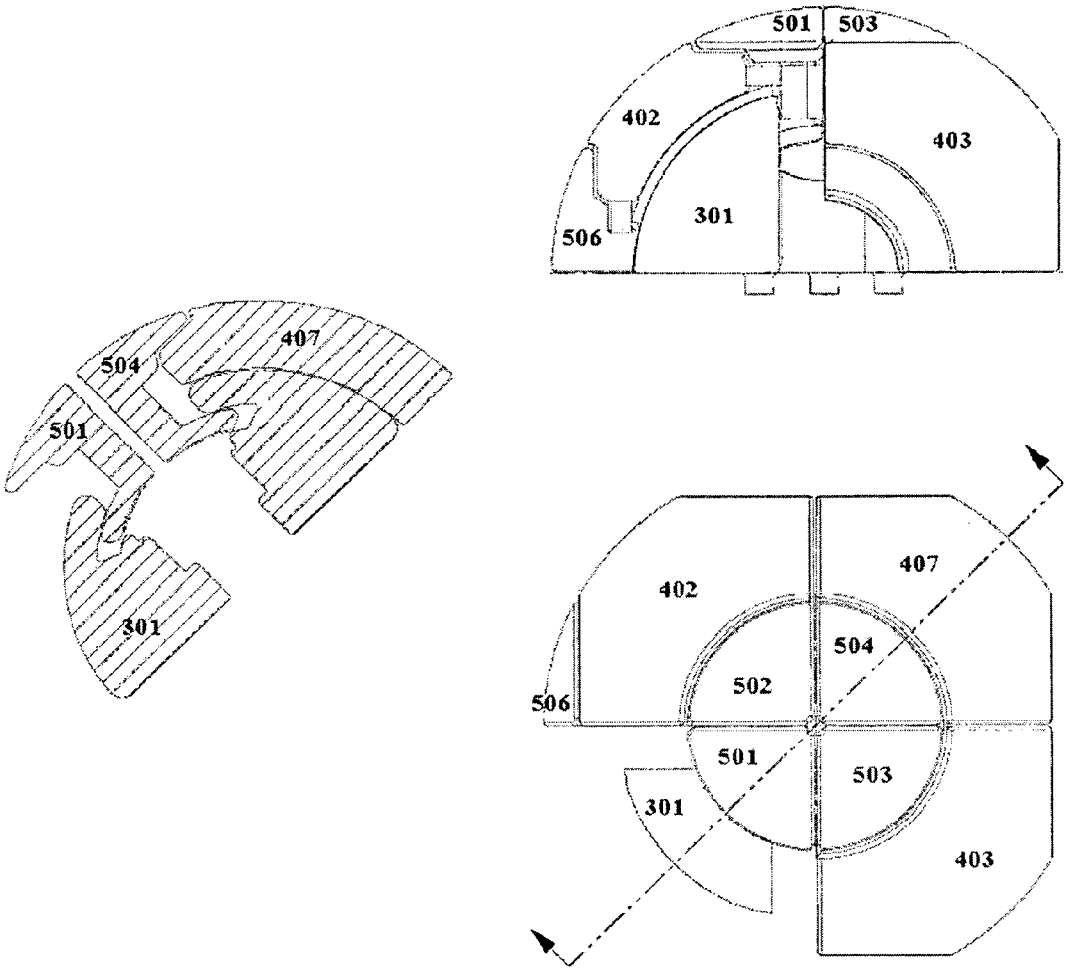
FIG. 8 is a cross sectional view the two polar sections (501 and 504) the core (301) and one shell octant (407) illustrating how the polar sections hold the shell octant sections by fitting into core grooves.

FIG. 7 shows the key elements of the core that enables only one hemisphere to rotate around the core at time and keep the rotational axis polar elements from rotating with the hemisphere. The core is comprised of channels with grooves. The channels support two sliders (601, 602, 603, etc), except for one of the core's channels is only half as wide, with a singular sliding element (201) that rotates about extraordinary axis of the core. The singular sliding element (201) is on one side of the equator of the extraordinary axis, and allows the rotation of that hemisphere The singular sliding element (201) has key features in its channel sections that prevent rotation of both sliding sections in the channel from rotating. The channel section has a raised lip or ridge (220) that stops one side of the sliders (601-624) from sliding. The side of the channel without the raised lip or ridge is the hemisphere that would rotate along that axis.

When a hemisphere rotates about the extraordinary axis of the core, part 201 is the slider that holds the polar sections on the ordinary axes at their proper distances which in turn allows the hemisphere (except the polar segments on the rotational axis) to rotate as in FIG. 2, FIG. 4, FIG. 5 and FIG. 6. When a hemisphere rotates about either of the other ordinary axes, parts 601-624 provide the assistance and proper spacing along the channels and grooves. These spacer elements (601-624)

Figure 12:
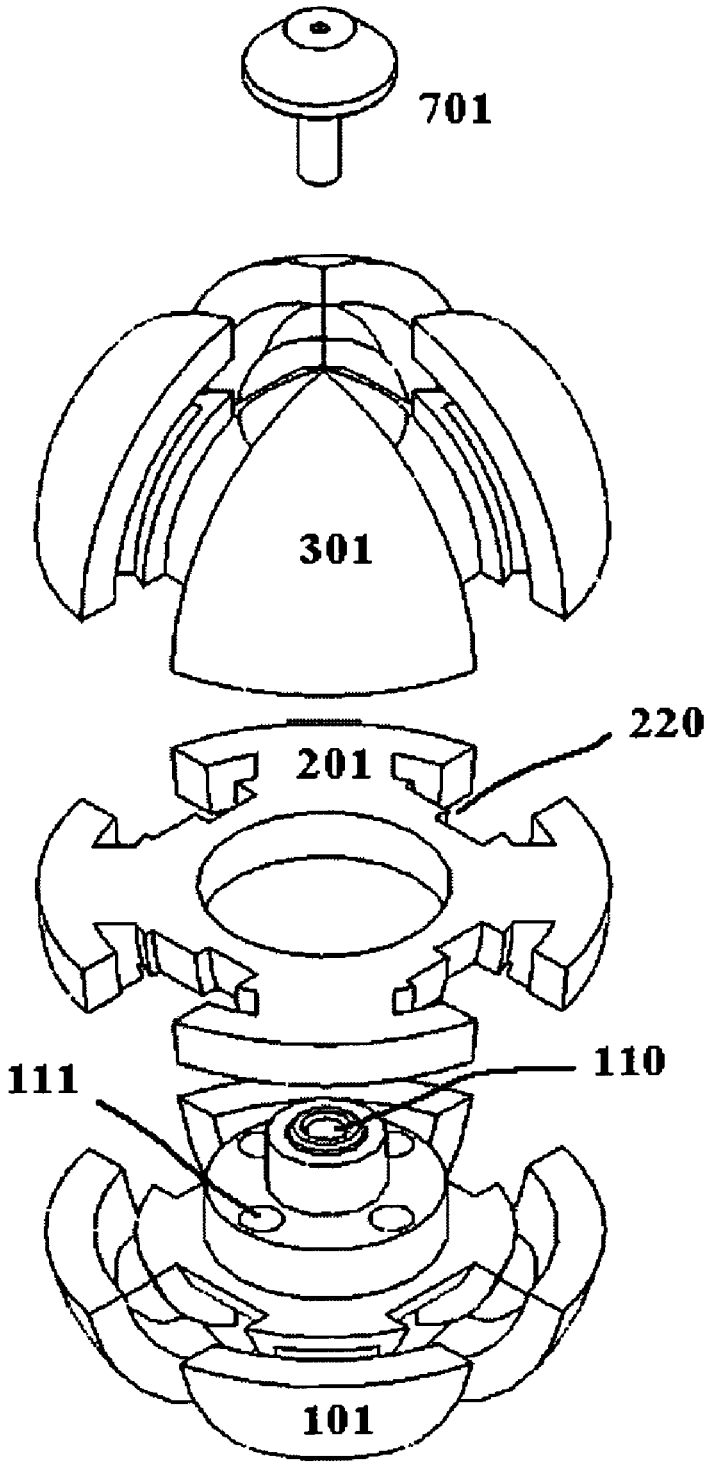
FIG. 12 is an exploded view of the core (101 and 301) and the extraordinary slider section (201). Core sections can be fastened together as shown with a screw (701) that would screw into center of core element 101 (110). Core element 101 mates into 301 and is aligned by assisting holes (111) and projections in core section 301. One of the lips of the extraordinary slider section (201) is also highlighted (220).
Figure 13:
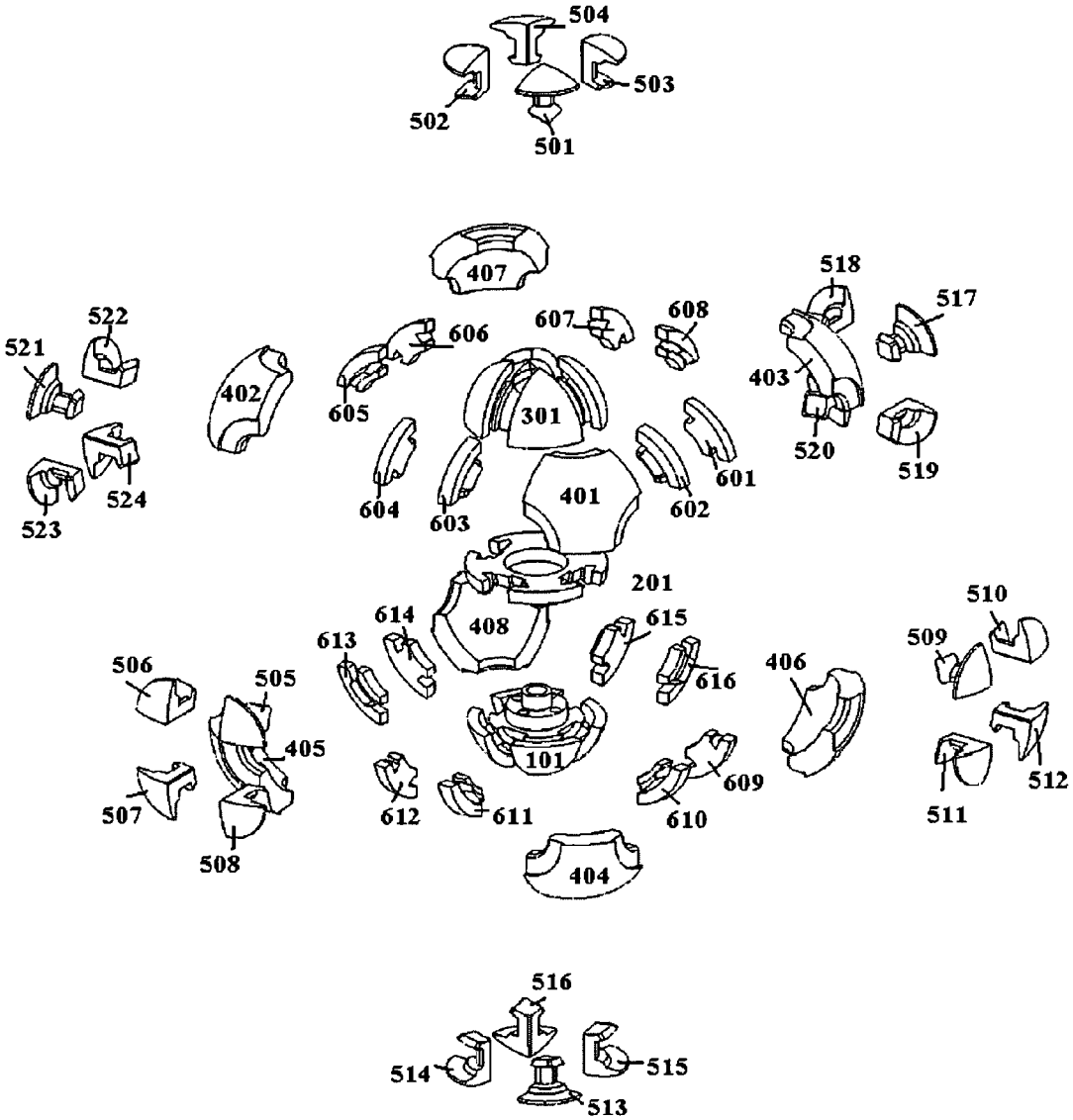
FIG. 13 is a full exploded view of the invention

As illustrated in FIG. 12, the core elements (101 and 301) can be fastened together by a screw, locked together by lips and grooves in the mating components of the two core elements, or any other fastening mechanism. Extraordinary axis sliding or spacer element (201) the shape of a cylinder with protruding tongues on one side and with four channels containing grooves of the core is held in place by the two core sections when fastened together. Two-axis core element (301) in the shape of a half sphere contains four channels (150 FIG. 7) with grooves (151 FIG. 7) along two planes perpendicular to each other. These channels hold in place the spacer elements (601, 602, etc) by means of their protruding tongues and quarter polar elements (501, 502, etc) by means of their footer tongues (5023). Three-axis core element (101) contains the same 4 channels with grooves as the two-axis core element, as well as a fifth channel with similar grooves that holds the extraordinary axis spacer element and in place. All the channels with grooves in the two core elements hold in place but also allow rotation of the spacer elements, quarter polar elements and extraordinary axis spacer element about the channels respective axis.

ALTERNATIVE EMBODIMENTS

Figure 10:
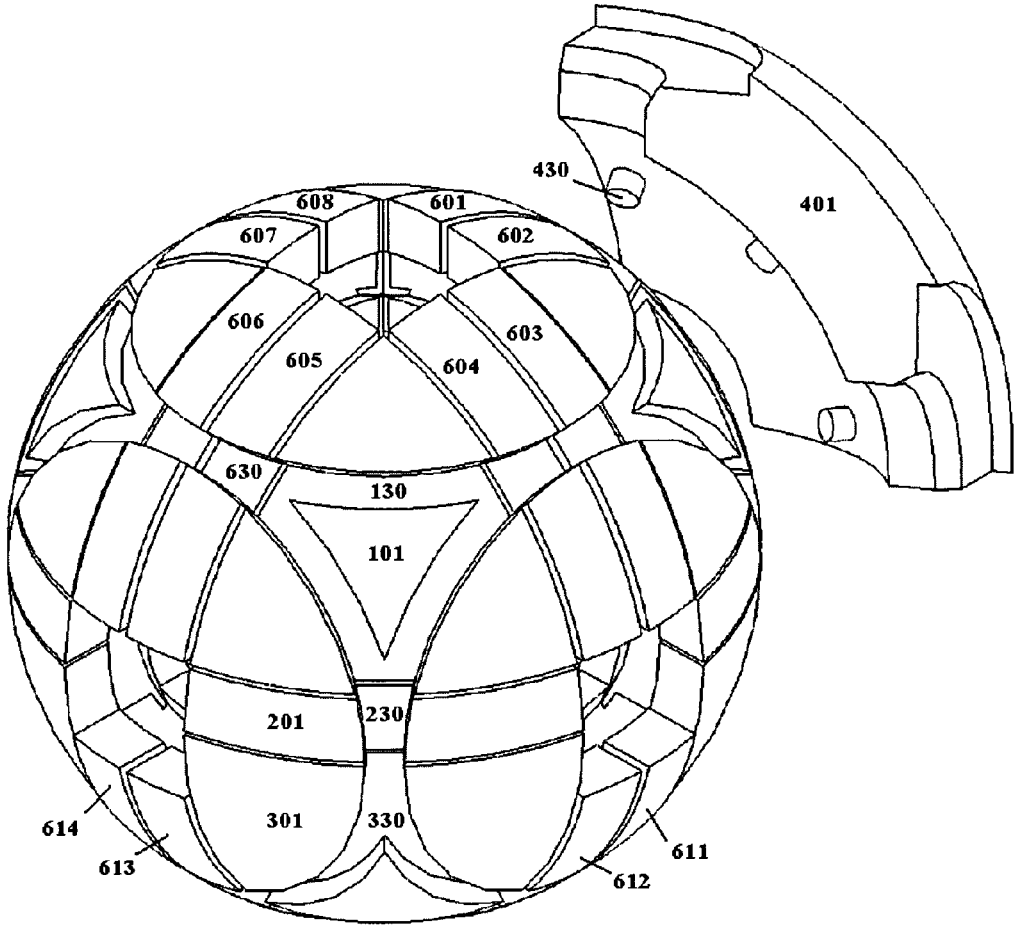
FIG. 10 is a view of the core (101, 201 and 301) slider sections (601-614) and a shell section (401) illustrating a variant of the invention where the core and slider elements have aligned grooves on the surface that would guide shell projections (430) along the surface, assisting the shells alignment and rotations along the core and slider surfaces.

In one variant of the invention FIG. 10, parts 401-408 contain knobs facing towards the center of the sphere on each of the octant edges (430). These knobs fit into the surface grooves on the core (130, 230 and 330 of parts 101, 201, and 301) and slider sections (630 of parts 601-624). The knobs closest to the equator that is rotating remain at the surface grooves of the sliding sections (650 of parts 601-624 or 201) while the other two knobs of each shell octant (401-408) slide along the surface grooves of the core (120, 220, and 320 of elements 101, 201, and 301) and slider sections (650 of parts 601-624 or 201).

Figure 11A:
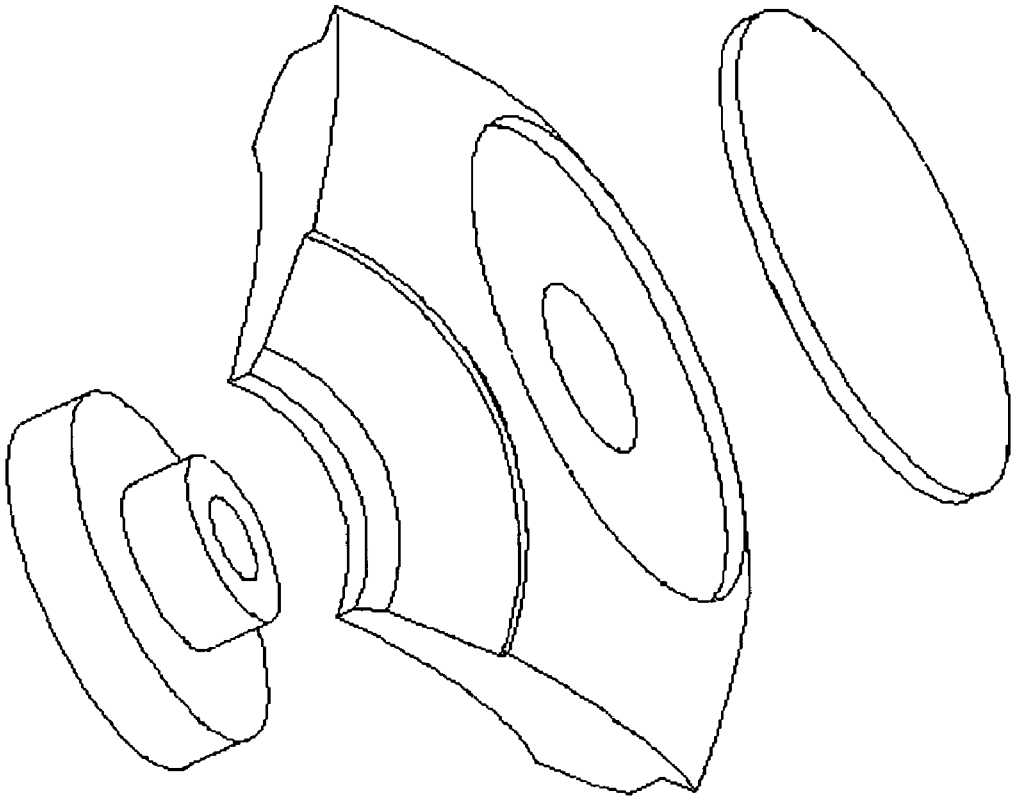
FIG. 11*a* is a view of a variant of invention, where the shell octant sections contain a circle that can rotate in its center. The surface of this rotating section that is facing to the center of the sphere could contain a projecting knob that would slide in grooves of the surface of the core and sliding sections similar to what is illustrated in FIG. 10. The two sections can be fastened by any screw or locking mechanism. This provides added rotational sections on the surface creating a variant of the puzzle based on the same invention.
Figure 11B:
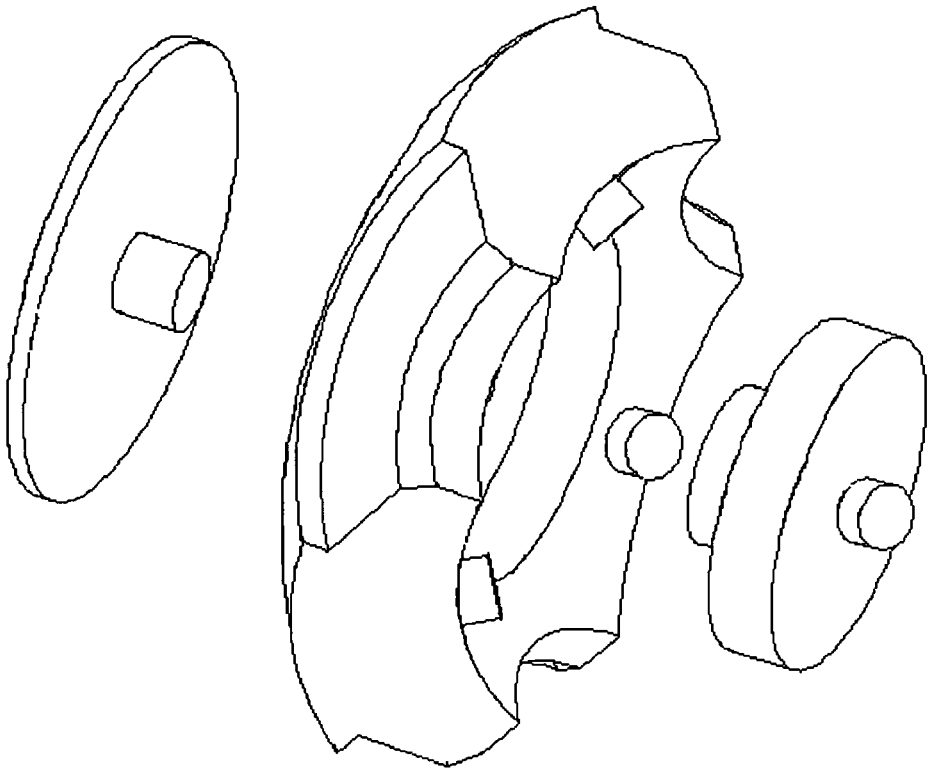
FIG. 11*b* is a view 11*a* rotated around to show the other surfaces of the components. This view shows the projecting knob of the shell similar to FIG. 10 and the knob of the rotating section as described in FIG. 11*a*.

Other variants illustrated in FIGS. 11*a* and 11*b* contain smaller rotating components in the octant shell sections. The bottom section of these rotation sections may contain a knob similar to the knobs on the octant sections, and will follow grooves on the surface of the core to rotate the section as a hemisphere rotates. The introduced rotating sections may not have these knobs and may rotate freely, as another possible variant to the invention.

Figure 9A:
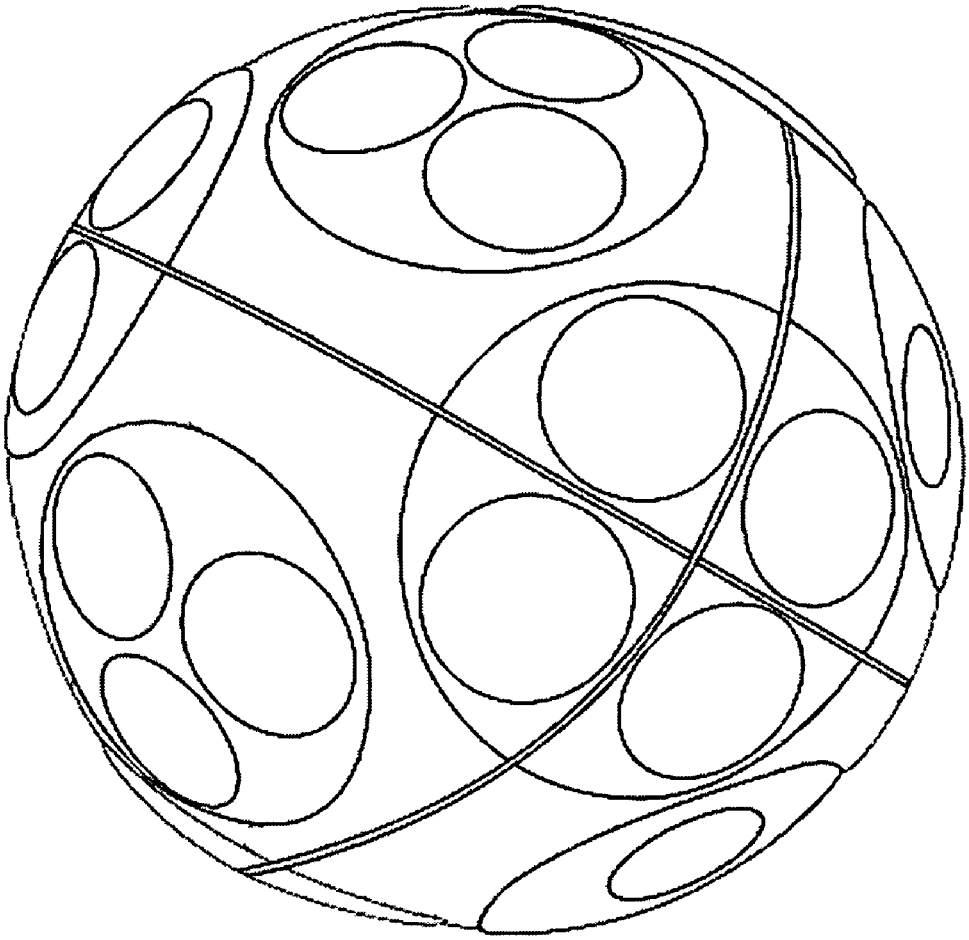
FIG. 9*a* is a different view of an embodiment of the invention with a set of circular patterns on the shell octant sections and quarter polar sections. The circular patterns can be colored in various patterns to form the puzzle.
Figure 9B:
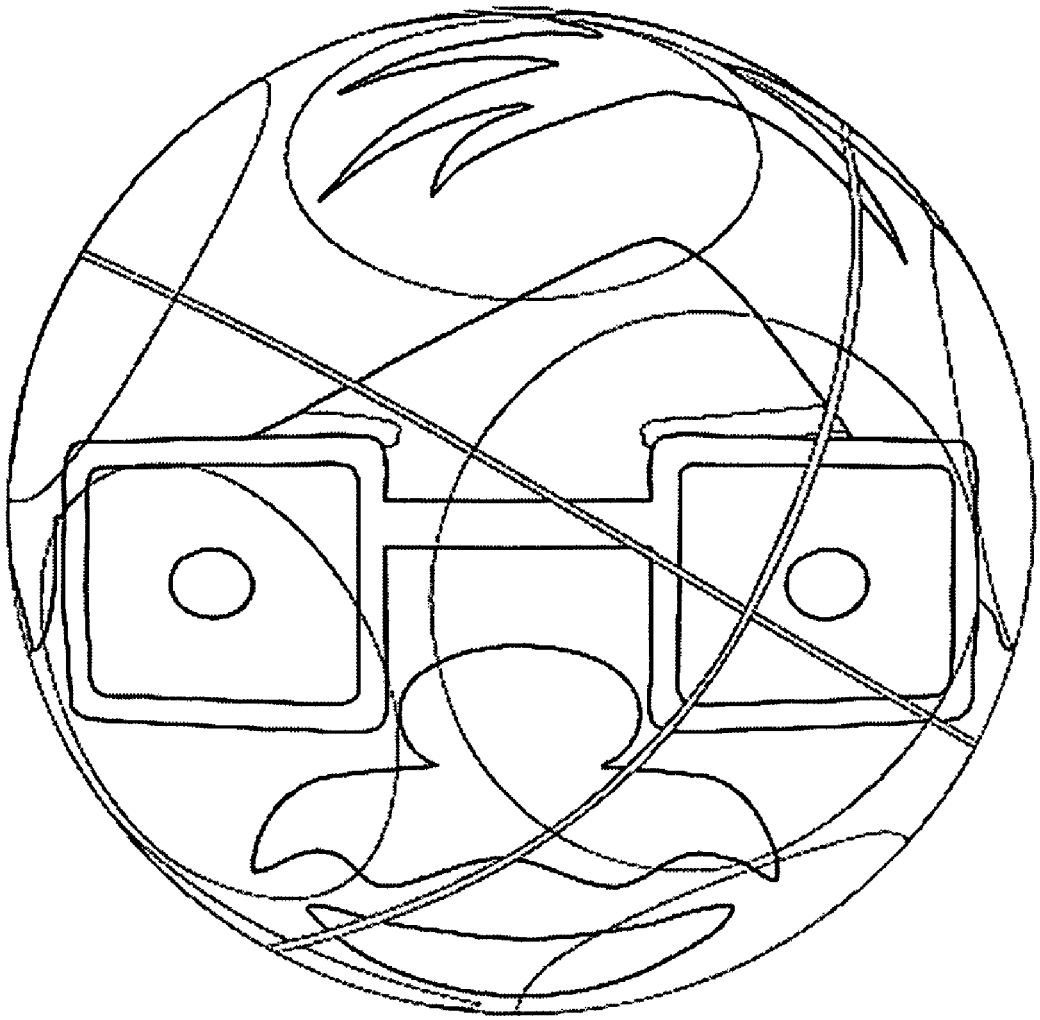
FIG. 9*b* is a different view of an embodiment of the invention with a image pattern on the surface of the shell octant sections and quarter polar sections to form the pattern on the surface that is to be aligned.
Figure 9C:
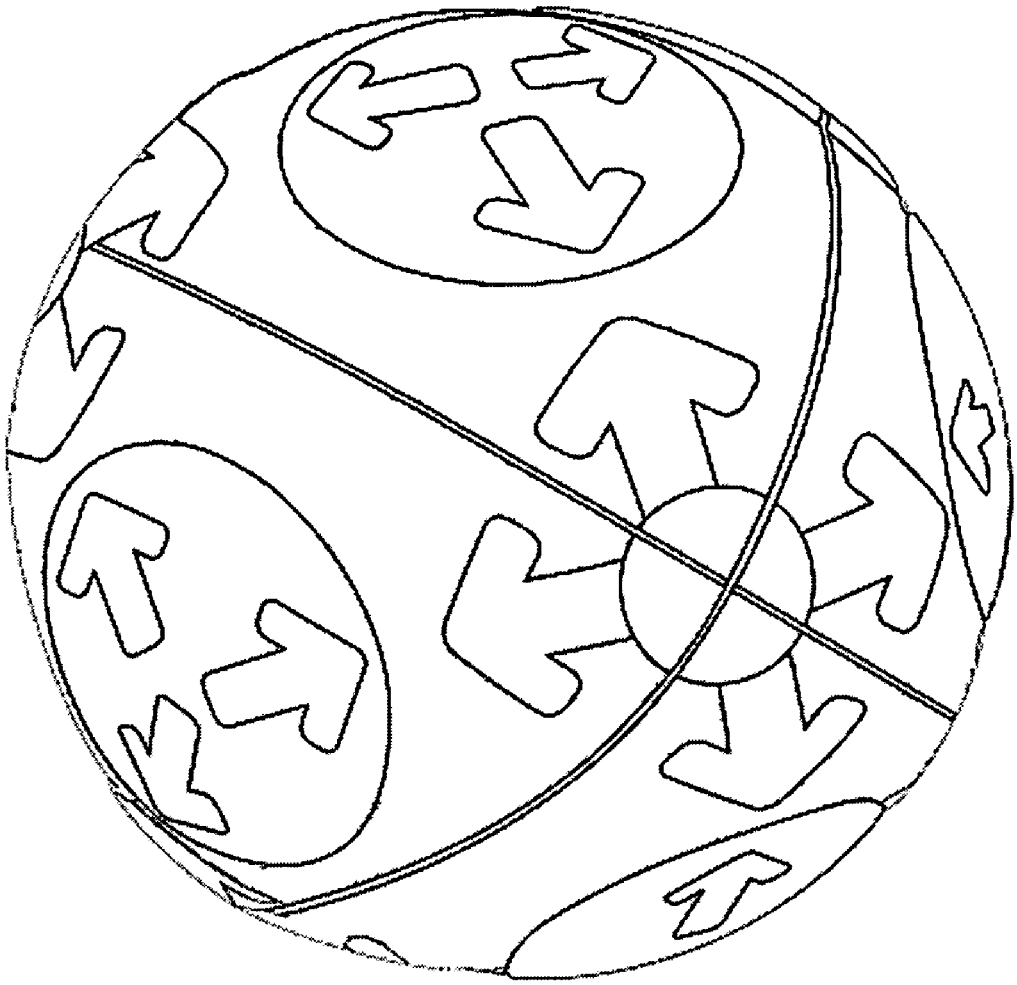
FIG. 9*c* is another view of an embodiment of the invention with a set of patterns on the shell octant sections and quarter polar sections. The patterns can be colored in various ways to form the puzzle.

FIGS. 9*a*, 9*b*, and 9*c* show potential embodiments with possible patterns on the surface of the invention that creates variations of the puzzle without variation of the mechanism. Alternative shapes of the overall puzzle may also be used that are not necessarily spherical, such as cubic or spiked sphere. In the case of a cubic embodiment, the polar quarters would be in the center of a cubic face, and shell elements would be expanded to create the corners of the cube.

While the subject invention is described and illustrated with respect to certain preferred and alternative embodiments, it should be understood that various modifications can be made to those embodiments without departing from the subject of invention, the scope of which is defined in the following claims.

What is claimed is:

1. A manipulable spherical logical puzzle comprising:

(a) a two-axis core element in the shape of half a sphere with four channels containing grooves on the surface along two planes perpendicular to each other and perpendicular to the equator of the half sphere;

(b) a three-axis core element in the shape of half a sphere, with five channels containing grooves, where four channels mirror said two-axis core element's four channels and the fifth channel deeper than the other four channels, containing a groove is along the equator, and equator section is connected to said two-axis core element's equator;

(c) an extraordinary axis spacer element in the shape of a cylinder containing protruding tongues from one side that fits in said three-axis core element's equatorial channel and grooves, with four channels containing grooves that line up with said three-axis core element's four channels with grooves, where half of each channel has a raised ridge;

(d) sixteen ordinary axes spacer elements in the shape of quarter cylinder, two of which fit in said two-axis and three-axis core elements' four channels, and contain protruding tongues that fit in said two-axis and three-axis core element's channel grooves, and contain grooves that line up with said two-axis and three-axis core element's channel grooves on either side;

(e) twenty-four quarter polar elements comprising a header shell header, a footer tongue, and a shaft, whereby the tongue footers and shell headers are connected by the shaft, and wherein two quarter polar element's shafts fit in said two-axis and three-axis core element's four channels, and one of which fits in said three-axis core element's equatorial channel, the footer tongue fits in said two-axis and three-axis core element's channel grooves and said extraordinary axis and ordinary axes spacer element's grooves;

(f) eight octant spherical shell elements with rounded out corners where said quarter polar element's shaft fits, and ledges around the rounded out corners on the exterior of the corner of the spherical shell octant element perpendicular to the axis of each corner where said quarter polar element's shell header extends over the octant shell corner and holding the eight octant spherical shell elements onto the surface of said two-axis and three-axis core elements and said extraordinary axis and ordinary axes spacer elements;

wherein said extraordinary axis spacer element located in said three-axis core element's deeper equatorial channel, allows rotation of said quarter polar elements and four of said eight octant spherical shell elements about the equator of the core on the side of said three-axis core element, and said extraordinary axis spacer element's channel ridges allow only one half of said quarter polar elements and four of said eight octant spherical shell elements about either of the ordinary axes of said two-axis and three-axis core elements through one half of said two-axis and three-axis core elements' four channels with grooves, and said octant spherical shell elements' rounded out corners allow rotation of four of said octant spherical shell elements about the axis of four quarter polar elements which do not rotate and stay stationary with the core and the opposite non-rotating hemisphere.

2. The puzzle defined in claim 1, wherein said eight octant spherical shell elements containing small knobs protruding from the inner surface, which fits into said two-axis core element, said three-axis core element, said extraordinary axis spacer element and said ordinary axes spacer elements containing small surface grooves to allow guiding for said octant shell elements upon rotation around said two-axis and three-axis core elements' surface.

3. The puzzle defined in claim 1, wherein said eight octant spherical shell elements contain rotatable cylindrical members in the center of the octant, which can freely rotate with respect to the octant.

4. The puzzle defined in claim 1, wherein said eight octant spherical shell elements contain rotatable cylindrical members in the center of each octant, where the cylindrical members have small knobs protruding from the inner surface, and would guide rotation of the cylindrical members by means of grooves on the surface of said two-axis core element, said three-axis core element, said extraordinary axis spacer element and said ordinary axes spacer elements.

5. The puzzle defined in claim 1, wherein said octant shell and quarter polar elements' exterior surfaces have various colors, symbols, images or patterns allowing them to be scrambled and then rearranged in predetermined patterns by movement of said octant shell and quarter polar elements about said two-axis and three-axis core elements.

* * * * *